United States Patent [19]

Van Woensel

[11] Patent Number: 5,044,994

[45] Date of Patent: Sep. 3, 1991

[54] CONNECTOR ASSEMBLY WITH CODING MEANS

[75] Inventor: Johannes Maria B. Van Woensel, Rosmalen, Netherlands

[73] Assignee: E. I. Du Pont de Nemours and Company, Wilmington, Del.

[21] Appl. No.: 509,413

[22] Filed: Apr. 9, 1990

[30] Foreign Application Priority Data

Apr. 14, 1989 [NL] Netherlands ..... 8900947

[51] Int. Cl.[5] ..... H01R 13/64

[52] U.S. Cl. ..... 439/681

[58] Field of Search ..... 439/677, 679, 680, 681

[56] References Cited

U.S. PATENT DOCUMENTS

| | | | |
|---|---|---|---|
| 3,184,707 | 5/1965 | Anderson | 339/186 |
| 4,350,409 | 9/1982 | Kato et al. | 439/681 |
| 4,365,857 | 12/1982 | Watanabe et al. | 439/681 X |
| 4,397,513 | 8/1983 | Clark et al. | 339/91 R |
| 4,640,566 | 2/1987 | Matsusaka | 439/350 |
| 4,709,976 | 12/1987 | Nakama et al. | 439/350 |
| 4,787,860 | 11/1988 | Bender | 439/358 |

FOREIGN PATENT DOCUMENTS

| | | |
|---|---|---|
| 0036770 | 9/1981 | European Pat. Off. . |
| 0156539 | 10/1985 | European Pat. Off. . |
| 2940457 | 4/1980 | Fed. Rep. of Germany . |

*Primary Examiner*—Larry I. Schwartz
*Assistant Examiner*—Julie R. Daulton

[57] ABSTRACT

A connector assembly comprising a female and a male connector part. At least one coding element is attached to each connector part. The coding element provides for a code face having at least one recess. The code faces of the male and female connector parts allocated to each other are complementary in shape. When connector parts allocated to each other are plugged into each other the faces of the respective coding elements engage with each other. Only a limited number of all possible code face shapes are used so that unambiguous code face sets are obtained.

7 Claims, 2 Drawing Sheets

CONNECTOR ASSEMBLY WITH CODING MEANS

BACKGROUND OF THE INVENTION

The present invention relates to connectors and more particularly to connectors for mating in a connector assembly having coding means which provide a sufficient number of unique codes for mating only predetermined connectors together.

Connector assemblies generally comprise male and female connector parts which mate together. The connector parts of such assemblies typically have polarizing arrangements to ensure that a male connector matingly engages with a female receptacle connector in only one possible alignment. An example of such a polarizing arrangement is shown in assignee's U.S. Pat. No. 4,787,860 which issued Nov. 29, 1988.

Connector assemblies have also been provided in the past with various keying or coding arrangements which are intended to ensure that only preselected connector parts can be plugged into each other. According to the European Patent Application 0 036 770, a number of equal first keying elements are selectively disposed at any of a plurality of predetermined positions on the housing of one connector, while a number of equal second keying elements are selectively disposed at any of a plurality of given positions on the body of a mating connector with each corresponding to one of the predetermined positions on the first connector housing. The keying elements are shaped and arranged such that engagement between the contacts of both of the connectors in prevented by engagement between the keying elements on the first connector and those of the mating connector.

Another coding arrangement is shown in German patent application 2 940 457. Each connector is provided with two code faces, each having one recess. The code faces of the female connector are constituted by two equal keying means each having said one recess. The male connector is provided at its outer surface with two equal keying means presenting two code faces which are complementary to that of the corresponding code faces of the female connector. In these prior connector assemblies, the code face or faces of each connector are formed by a number of keying means. Consequently, a number of steps must be carried out for constituting the code face of each connector.

After the selection of a specific combination of tabs and slots, they can be modified only to a limited degree. Such connector assemblies thus have the disadvantage that the allocation of female parts to male parts is not very flexible. In addition, the coding in such prior art connectors is time-consuming and is not unambiguous.

SUMMARY OF THE INVENTION

The connector assembly of the present invention provides a flexible, unambiguous and readily modifiable coding system. At least one coding element is attached to each connector part, in which one code face with at least one recess is formed, and the code faces of male and female connector parts predetermined to mate with each other are complementary in shape and engage with each other in the plugged in position of the parts.

The user can order connector parts with predetermined coding elements. If desired, the coding elements can be supplied separately and quickly attached to a connector part by the user in few simple steps.

It is always possible to replace the preselected coding elements with other coding elements which have faces with different shapes. When the coding element of a particular connector part has to be replaced with another coding element which has to engage with an element of a different connector part, it is not necessary to order new connector parts. Only the coding element need be replaced. One advantage of the invention is that advanced standardization of connector parts is therefore possible.

According to one embodiment, the code face extends parallel to a side face of the connector part. Each recess preferably extends continuously in the plug-in direction, so that the front face of the male part can rest closely against the bottom face at the back of the female part within the socket.

Only a limited number of the total number of code face shapes possible in a predetermined coding is used, each code face shape fitting only the complementary shape from the remaining number. In this way, an unambiguous allocation between connector parts is achieved.

In prior art connectors, ambiguities could result from errors as to the position of the keying means. By using one coding element for each connector and the limited number of the total number of code face shapes according to the present invention, such errors and ambiguities are eliminated.

In practice, nineteen 12 mm connector modules could be located on a standard size printed circuit board 233 mm high. By using the present invention, cables provided by a connector would mate with only one preselected connector module of the printed circuit board. Furthermore, a number of printed circuit boards provided with abovedescribed connector modules can be electrically coupled to each other through the respective connector modules. When the coding keys are based on 6 bits, 20 unambiguous combinations are possible. Of course, it is possible to make coding sets based on more or less than 6 bits.

In a preferred embodiment, the male connector parts and the coding elements intended for them are provided with snap-in connecting elements and the female connector parts and the coding elements intended for them with bayonet-type connecting elements.

A predetermined number of coding elements are preferably connected by means of a runner, the distance between the coding elements corresponding to the distance between them in a number of female or male connector parts disposed adjacent to each other. This is particularly advantageous if a connector part is assembled from a number of adjacent male or female connector parts. In one operation all coding elements can then be attached in the correct place to the above-mentioned connector part, following which the runner can be removed. A subsequent change in the sequence or type of the coding elements is still, however, possible.

BRIEF DESCRIPTION OF THE DRAWINGS

The invention will be explained in greater detail below with reference to the drawings, in which.

DETAILED DESCRIPTION OF THE EMBODIMENTS

Figure 1:
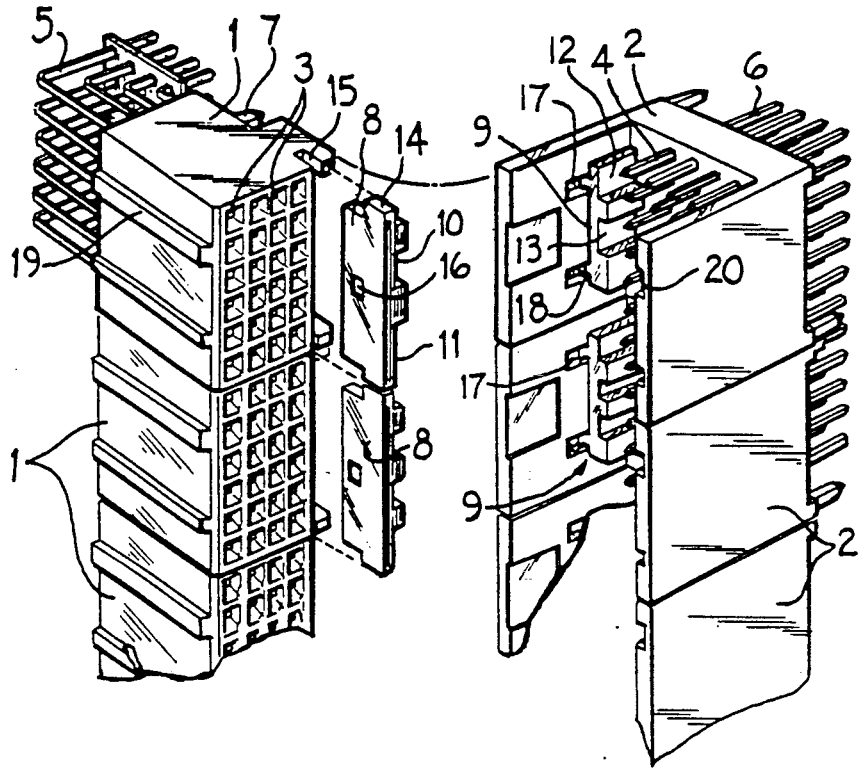
FIG. 1 is a view in perspective of an embodiment of a connector assembly according to the invention, in which the connector parts are not plugged into each other.
Figure 2:
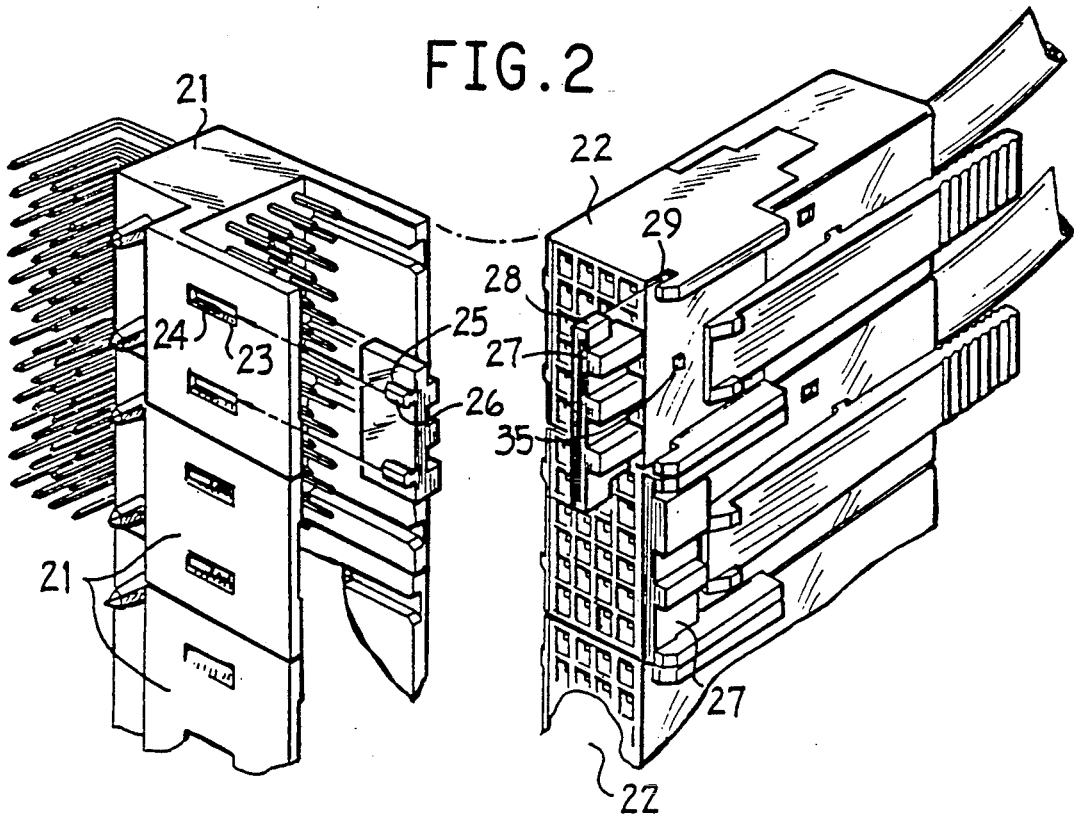
FIG. 2 shows a view in perspective of another embodiment of a connector assembly according to the invention.

A connector assembly generally includes a female connector (also referred to as a socket or receptacle connector) and a male connector (also referred to as a plug connector) which mate together. FIGS. 1 and 2 illustrate such assemblies. In the embodiment of FIG. 1, part 1 is the male connector and part 2 is the female connector. In the embodiment of FIG. 2, part 21 is the female connector and part 22 is the male connector. The female connector typically is in the form of a socket with walls defining a space into which the male connector is inserted.

Coding elements according to the invention are attached to the connector parts by means of connections which may or may not be detachable. The coding elements of the female connector each have a face which extend at a specific angle relative to the wall of the female part. The coding elements of the male connector also have faces which extend so that the faces lie against each other when the connector parts are plugged into each other.

One face is provided according to a coding with one or more recesses. If only one specific male part may be plugged into a female part, the coding faces have a unique complementary profile shape. When the connector parts are plugged into each other, the projections of one face fit into the recesses of the other face and thus match so as to be in engagement with each other. If one tries to plug parts which have coding elements without a complementary profile into each other, a projection of one coding face will not match the recess of the other coding face, but will abut against the coding face, so that the connector parts cannot be fully plugged into each other, indicating that the connector parts in question do not belong to each other.

The coding faces may be perpendicular to the plug-in direction. One coding element is fixed within the socket near the bottom of the female part, while the coding element of the male part is fixed at the free end thereof. In this embodiment, the connector parts allocated to each other still cannot be plugged into each other fully. The front face of the plug-in part cannot rest against the bottom face of the female part. If connector parts not allocated to each other are plugged into each other, the front face of the male part will lie even further from the bottom face of the female part, indicating that the parts do not belong to each other. Two connector parts allocated to each other can be plugged fully into each other if the coding element of the socket part is recessed in the bottom of the socket part in such a way that the recesses and the bottom face lie in line with each other.

In the preferred embodiments of FIGS. 1 and 2, the coding faces extend parallel to the plug-in or insertion direction of the connector parts. The connector assembly of FIG. 1 comprises the aforementioned connector parts 1 and 2 which are to be plugged into each other. The male connector part 1 is formed of a housing of electrically insulating material which has disposed therein female contacts 3. The female connector part 2 is also formed of a housing of electrically insulating material provided with male pins 4 which are intended to mate with the female contacts 3 of connector part 1. The female contacts 3 are connected to the connecting pins 5 extending from connector part 1. Pins 4 are connected to connecting pins 6 which extend from connector part 2.

The connector part 1 is secured to a printed circuit board (not shown) by means of pins 7 (only one of which can be seen). Pins 7 are inserted into corresponding holes provided for them in the printed circuit board. The connecting pins 5 are also inserted into holes provided for them in the printed circuit board. The connector part 2 can also be secured to a separate printed circuit board. This connector assembly thus provides connections between printed circuit boards which have to be positioned perpendicular to each other.

Moreover, due to the modular nature of the connector parts, a number of these connectors can be stacked side-by-side along the edge of a printed circuit board. FIG. 1, for example, shows a number of male connector parts 1 which are stacked side-by-side and corresponding number of female connector parts 2 also stacked side-by-side.

The connector parts 1 and 2 are provided with coding elements 8 and 9 respectively. The coding element 8 has two recesses 10 and 11, while the coding element 9 has two recesses 12 and 13 where the coding element 8 has no recesses. The cross-sectional profiles of the coding elements are complementary to one another. Thus, the portions between the recesses of each coding element is higher so as to slidingly fit into the space defined by the other's recesses. The shapes of the coding elements 8 and 9 are thus uniquely complementary. Male and female connector parts can thus be allocated to each other through the use of this unique coding of recesses.

The recesses in the coding elements continuously extend in the entire plug-in or insertion direction. This means that the male connector part 1 can be plugged completely into the female part 2 allocated to it so that the front of the male part 1 rests closely against the bottom face at the back of the female socket part 2. As a result of the continuous extension of the recesses, the coding elements 9 need not be placed at the back of socket connector part 2. The coding elements 9 can even be fixed near the front of the socket opening of part 2 at a great distance from the back, on the side wall of the connector socket part 2. The corresponding situation applies to the connector part 1, namely the arbitrary position of the coding element 8.

In the embodiment of FIG. 1, the coding element 8 has a narrower part 14 which fits into a recess 15 of the connector part 1. The coding element 8 is fixed in the connector part 1 by means of a detachable fastening which in this embodiment is a snap connection. When the coding element 8 is fitted in its place on the connector part 1, a snap-in element (not shown) on the connector part 1 engages with the snap-in recess 16. If another coding element is desired, the coding element 8 can be pressed out of the recesses 15 and the new coding element can then be pushed into place.

The detachable fixing means for the coding element 9 on the connector part 2 comprise projections 18 of the coding element 9 engaging with slots 17 of the connector part 2. This fastening is a so-called bayonet closure, which will be described further with reference to FIG. 2. it is clear that other fastening means for the coding elements 8 and 9 to the respective connector parts are possible.

When the connector parts 1 and 2 are plugged into each other, the faces of the coding elements 8 and 9 extending parallel to the plug-in direction slide along each other. The elevations match precisely with the associated recesses.

The connector part 1 is provided with ribs 19 which slide along the inside of the walls of socket connector part 2 into recesses 20 when the connector parts are plugged into each other. The mating between the ribs 19 and the recesses 20 has the advantage that the male part 1 can be plugged into the female part 2 in only one position and no wrenching forces can be exerted on the pins.

In the embodiment of FIG. 2, the connector assembly includes a female connector part 21 and a male cable connector part 22, in which—as in FIG. 1—for the sake of clarity, the coding elements are not fitted in their place on the connector parts. A boyonet closure is used for securing the coding element to connector part 21. The fixing slots 23 of the connector part 21 are clearly visible in this figure. These slots 23 are narrower at the lefthand side, due to thin longitudinal ribs 24. The coding element 25 is provided with projections 26, which are broader at the free end. When the coding element 25 has to be fixed on the female connector part 21, the projections 26 are plugged in at the righthand side of the slots 23, and the coding element 25 is then pushed to the left in the direction of the bottom or back of the female part 21, where the thickened ends of the projections 26 grip behind the longitudinal ribs 24.

A snap-in connection is also provided in the embodiment for fixing of the coding element 27 to the cable connector part 22. When the coding element 27 is pushed into the recesses 29 with its narrower ends 28, the projection 35 disposed on the wall of the connector part 22 engages behind a recess (not visible) of the coding element 27.

A bayonet closure is thus selected as the preferred embodiment of fastening means for the coding elements 25. A snap-in connection is selected for fastening the coding element 27 to the cable connector part.

Further corresponding parts of the connector parts 21 and 22 are provided with the same reference numbers, so that a further description of the connector assembly according to FIG. 2 is unnecessary. It should also be pointed out that the female connector part 21 can be fixed on a printed circuit board, but unlike FIG. 1, the male connector part 22 is provided with a cable. A cable can be connected to tracks on a printed circuit board here.

The connector parts can be supplied as standard parts without coding elements. Each coding element can be ordered separately as desired.

Figure 3:
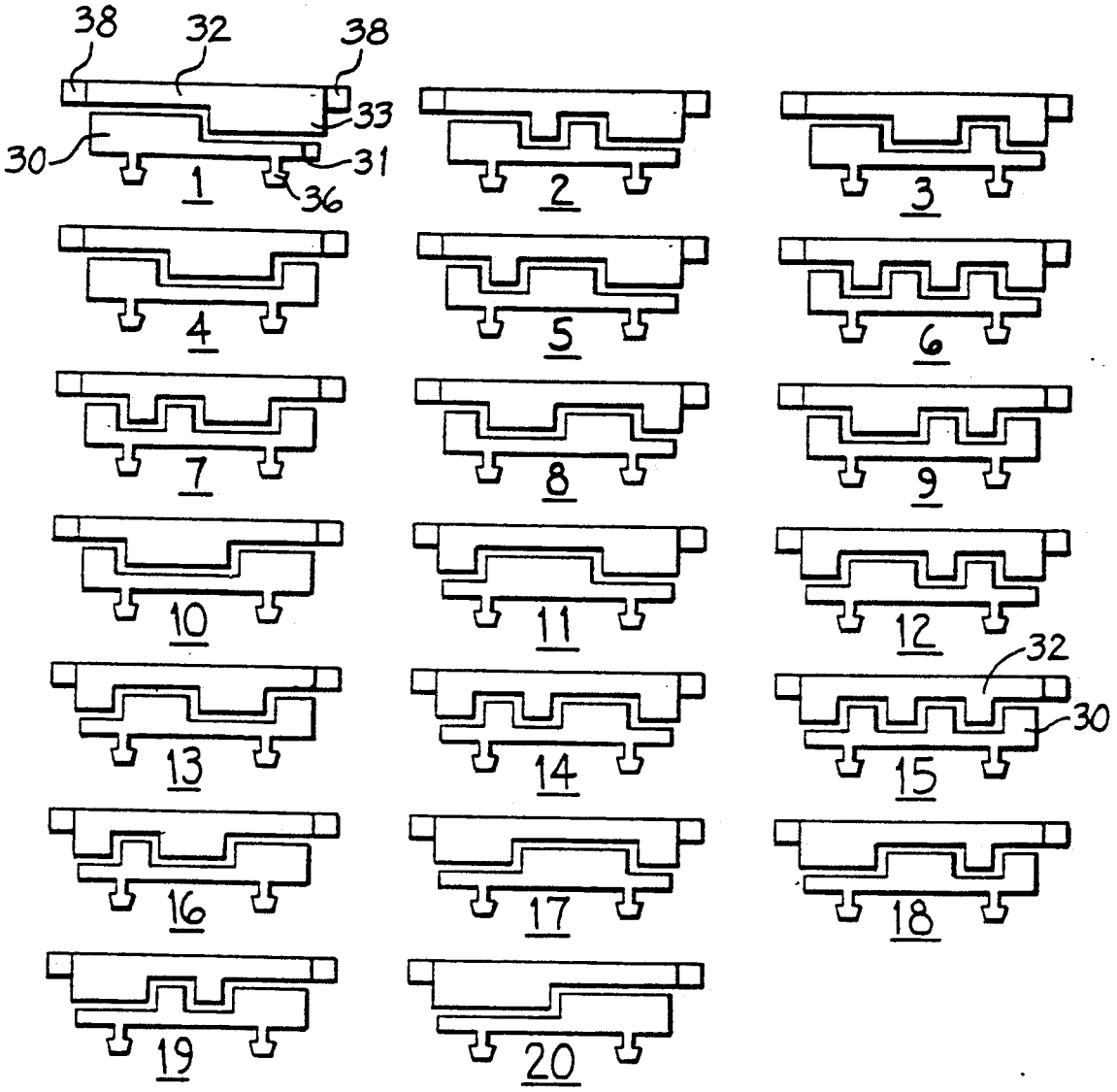
FIG. 3 shows side views of a number of examples of coding elements of connector parts belonging to each other.

Any number of recesses can be provided in the complementary coding elements, as desired. The recesses are preferably provided according to a particular code. An example of a number of different coding elements possible from a code of 6 bits is shown in FIG. 3 which illustrates 20 different codes for complementary coding elements 30 and 31. Varying number of recesses with varying widths can be forward from the 6 bits. Thus, as shown in the first code (code 1), 3 bits removed from each coding element form a code with a recess 31 at one side of one-half the width of the code face. The face of the corresponding coding element 32 facing the coding element 30 will then have a complementary shape. In code 15, the coding element 30 has three recesses. Each recess represents one bit, alternating with a non-recessed bit. Again, coding element 32 has a complementary shape. Recesses of widths from 1-5 bits may be positioned at different locations along the coding element face as shown in 20 codes illustrated in FIG. 3.

It is clear that with a coding of 6 bits, a large number of complementary shapes are possible. However, amiguities are possible since a coding element which has both a projection and recess within the width of the recess 31 will also fit into the coding element 30 of code 1. In order to be able to obtain unambiguous allocation between the connector parts, only a limited predetermined number of the total number of code face shapes possible in a coding will be used so that only the complementary shape from the remaining number will fit with each code face shape. When a coding element is selected from the limited number, only one coding element will always mate with it, namely the coding element with the complementary shape. As a result only a preselected male connector part can be plugged into the particular female connector part associated with it. By using a coding of 6 bits, 20 unambiguous sets can be obtained, as show in FIG. 3.

By means of the detachable fastening means, such as the bayonet closure and snap-in connection described above, the coding elements can be inserted quickly and easily into and removed from the connector parts. Coding elements 31 in FIG. 3 are each shown having projection 36 for bayonet closure engagement in the slots of the connector parts while coding elements 32 are each shown with narrower ends 38 which fit into the recesses for snap in engagement with the connector parts. The allocation of the connector parts to each other by means of the detachable coding elements is thus optimally flexible and is unambiguous by the above-mentioned limitation of the number of codes.

The connector assemblies according to FIGS. 1 and 2 comprise a number of adjacent female connector parts arranged in the side-by-side stacking arrangement described above. Corresponding male connectors are to be plugged into corresponding female connectors of the stack. A coding element is fixed in the slots 17, 23 of the first (female) connector part 2, 21, while a complementary coding element is pushed into the slots 15, 29 of the first (male) connector part 1, 22. A coding element having a different code can be fixed in the slots of the next female connector part 2, 21 which is stacked adjacent to the first. The male connector part 1, 22 which has to be plugged into this next female connector part will then be provided with a coding element with the same code in complementary shape. The two connector parts 1, 22 can thus only be plugged into the place designated for them.

Figure 4:
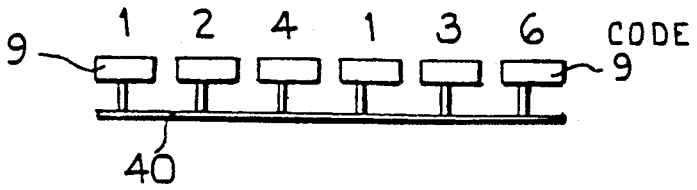
FIG. 4 shows a front view of coding elements put together to form a strip.

FIG. 1 shows an example of an embodiment of a strip of coding elements. The coding elements 9 of female connector part 2 are indicated only schematically as blocks. FIG. 4 shows the front view of a stip of 6 coding elements 9 with the codes 1, 2, 4, 1, 3 and 6 respectively. The coding elements 9 are connected to each other by means of a runner 40. The spacing between coding elements on the runner is selected so that it matches the spacing of the slots 17 on successively stacked female connector parts 2. The elements 9 with the runner can be fixed as a whole in the stack of female connector parts 2 and the runner 40 can then be removed. If one or more elements subsequently have to be replaced in order to obtain a different allocation, this can be carried out in a very simple manner resulting from the detachable fastening of the elements on the connector parts. A similar strip having coding elements 8 with faces complementary to those of strip of coding elements 9 can likewise be attached to the stack of male connector parts 1. In this manner, each respective female connector part 2 and male connector part 1 can receive the particular code intended for it and its mating connector part.

I claim:

1. A connector assembly comprising:

a male connector having a housing of electrically insulating material and having disposed therein a plurality of electrical contacts, each said contact having one contact end extending toward a front face of the male connector and second contact end extending in another direction, a female connector also having a housing of electrically insulating material and also having disposed therein a plurality of electrical contacts, each said contact having one contact end extending to meet and mate with said one contact end of a corresponding contact of the male connector when said male connector is inserted into the female connector, the other end of each female connector contact extending from said female connector in another direction, said female connector housing having side walls defining a socket space within which the housing of the male connector fits during insertion, and at least one coding element detachably secured to an outer surface of a side wall of the housing of the male connector, said coding element provided with a code face having a unique coding sequence comprising one or more recesses, at least a second coding element detachably secured along an inner surface of one of said side walls of the female connector defining the socket space so as to be within said socket space, said second coding element provided with a code face also having a unique coding sequence comprising one or more recesses which is complementary to the coding sequence of the code face of the first coding element and which will permit the female connector to mate completely with said male connector, each said code face having the same predetermined number of removable code bits, said recesses being formed by the removal of the same number of said code bits, more than one code bit being removable in each code face to form recesses of different widths and at different locations, a predetermined number of coding sequences being used for each code face which is less than all coding sequences possible for a particular code face to avoid ambiguous selections.

2. A connector assembly according to claim 1 wherein only a limited number of the total number of all code face shapes possible from the code bits is used, and only the complementary shapes from this limited number will fit with each code face shape, thereby avoiding ambiguous selections.

3. A connector assembly according to claim 1 wherein the male connectors and the coding elements for the male connectors are provided with snap-in connecting means, and wherein the female connectors and the coding elements for the female connectors are provided with bayonet closure connecting means.

4. A connector assembly according to claim 1 wherein a predetermined number of coding elements with different coding sequences are interconnected to each other connected by means of a runner.

5. A connector assembly according to claim 1 wherein each said code face extends parallel to said respective side walls of the male and female connector to which said coding elements are secured, each said recess extending the entire length of the coding element in the insertion direction.

6. A connector assembly according to claim 5 wherein each said code face comprises six code bits which can be removed to form said recesses and wherein said recesses can be formed of different widths by selecting adjacent code bits for removal according to a predetermined code sequence.

7. A connector assembly according to claim 6 wherein 20 unambiguous code sequences are possible by removal of different combinations of said six code bits on each code face.

* * * * *